US009883268B2

(12) United States Patent
Zhang et al.

(10) Patent No.: US 9,883,268 B2
(45) Date of Patent: Jan. 30, 2018

(54) LOUDSPEAKER MODULE

(71) Applicant: Goertek Inc., Weifang (CN)

(72) Inventors: Zhibing Zhang, Weifang (CN); Gang Chen, Weifang (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 15/521,585

(22) PCT Filed: Nov. 24, 2015

(86) PCT No.: PCT/CN2015/095421
§ 371 (c)(1),
(2) Date: Apr. 24, 2017

(87) PCT Pub. No.: WO2016/082743
PCT Pub. Date: Jun. 2, 2016

(65) Prior Publication Data

US 2017/0318367 A1 Nov. 2, 2017

(30) Foreign Application Priority Data

Nov. 28, 2014 (CN) ..... 2014 1 0713194

(51) Int. Cl.
*H04R 1/02* (2006.01)
*H04R 9/06* (2006.01)
(Continued)

(52) U.S. Cl.
CPC ..... *H04R 1/025* (2013.01); *H04R 7/127* (2013.01); *H04R 9/025* (2013.01); *H04R 9/06* (2013.01); *H04R 2499/11* (2013.01)

(58) Field of Classification Search
None
See application file for complete search history.

(56) References Cited

U.S. PATENT DOCUMENTS 7,718,927 B2 * 5/2010 Kent ..... H01L 23/13 219/421
2006/0279312 A1 * 12/2006 Kent ..... B23K 3/0653 228/260

(Continued)

FOREIGN PATENT DOCUMENTS

CN 1361564 A 7/2002
CN 203327230 U 4/2013

(Continued)

OTHER PUBLICATIONS

International Bureau of WIPO, International Search Report and Written Opinion in Application No. PCT/CN2015/095421, dated Feb. 6, 2016.

*Primary Examiner* — Paul Huber
(74) *Attorney, Agent, or Firm* — LKGlobal | Lorenz & Kopf, LLP; Seth E. Rodack; Timothy Lorenz

(57) ABSTRACT

The present disclosure provides a loudspeaker module and relates to the technical field of electroacoustic products. The loudspeaker module composes a housing, a loudspeaker unit being received in the housing, the loudspeaker unit is electrically connected with a module external circuit via a cable, an end of the cable located in the interior of the module is electrically connected with the loudspeaker unit, an end of the cable located external to the module is electrically connected with the module external circuit, a positioning slot is disposed at a position on the housing corresponding to the cable in the interior of the module, the cable is restricted in the positioning slot, a hot melt line is disposed on each of end faces of sidewalls on both sides of the positioning slot, and the hot melt lines, after being hot molten, encapsulate the cable in the positioning slot.

9 Claims, 3 Drawing Sheets

(51) Int. Cl.
*H04R 9/02* (2006.01)
*H04R 7/12* (2006.01)

(56) References Cited

U.S. PATENT DOCUMENTS

2010/0092024 A1 4/2010 Kaiya
2010/0294546 A1* 11/2010 Nickel ..... H05K 3/3405
174/255

FOREIGN PATENT DOCUMENTS

CN 104378719 A 2/2015
CN 204231648 U 3/2015

* cited by examiner

LOUDSPEAKER MODULE

CROSS-REFERENCE TO RELATED APPLICATION

This application is a U.S. National-Stage entry under 35 U.S.C. §371 based on International Application No. PCT/CN2015/095421, filed Nov. 24, 2015 which was published under PCT Article 21(2) and which claims priority to Chinese Application No. 201410713194.X, filed Nov. 28, 2014, which are all hereby incorporated herein in their entirety by reference.

TECHNICAL FIELD

This application pertains to the technical field of electroacoustic products, and particularly to a loudspeaker module.

BACKGROUND

Loudspeaker modules are important acoustic component in portable electronic devices, are used to complete the conversion between an electrical signal and an acoustic signal, and serve as an energy conversion device. Loudspeaker modules usually comprise a housing, a loudspeaker unit being received in the housing and further comprise an electrical connection component for electrically connecting the loudspeaker unit with a module external circuit. Since cables (a metallic conductor wire having an insulating skin) have advantages such as strong resistance against tension, high reliability and low resistance, and they can be assembled very easily when products are assembled, currently electrical connection components for electrically connecting the loudspeaker unit with the module external circuit mostly employ cables. However, since portable electronic devices constantly develop in a trend of light weight, slimness and small size, loudspeaker modules must become increasingly thinner and smaller. That causes large difficulty in installing and positioning cables in the loudspeaker modules. The difficulty mainly lies in the following two aspects:

1. The diameters of cables are excessively large and apt to hinder the circulation of air stream in the modules;

2. Current cables are all fixed by applying a glue, the fixing effect is undesirable and an undesirable uniformity of the internal structures of the module is caused.

The above two causes cause the degradation of the acoustic performance of the loudspeaker modules and undesirable product uniformity. In addition, other objects, desirable features and characteristics will become apparent from the subsequent summary and detailed description, and the appended claims, taken in conjunction with the accompanying drawings and this background.

SUMMARY

In view of the above drawbacks, the technical problem to be solved by the present disclosure is to provide a loudspeaker module. This loudspeaker module achieves effective positioning of the cable in a limited space, reduces the influence exerted by the cable on the air stream in the module, and exhibits a high acoustic performance and good uniformity.

To solve the above technical problems, the present disclosure employs the following technical solutions:

A loudspeaker module comprises a housing, a loudspeaker unit being received in the housing, the loudspeaker unit is electrically connected with a module external circuit via a cable, an end of the cable located in the interior of the module is electrically connected with the loudspeaker unit, an end of the cable located external to the module is electrically connected with the module external circuit, a positioning slot is disposed at a position on the housing corresponding to the cable in the interior of the module, the cable is restricted in the positioning slot, a hot melt line is disposed on each of end faces of sidewalls on both sides of the positioning slot, and the hot melt lines, after being hot molten, encapsulate the cable in the positioning slot.

Preferably, an extension direction of each of the hot melt lines is the same as an extension direction of the positioning slot.

Preferably, a longitudinal section of each of the hot melt lines is a right-angle triangle, a right-angle side of each of the hot melt tines overlaps the corresponding end face of the sidewall of the positioning slot, and the other right-angle side of each of the hot melt lines is disposed adjacent to an opening of the positioning slot.

Preferably, the other right-angle side of each of the hot melt lines is in the same plane as an inner surface of the sidewall of the positioning slot.

Preferably, the sidewalls of the positioning slot are two bar-shaped protrusions disposed parallel on an inner surface of the housing, a space between the two bar-shaped protrusions is the positioning slot, and the hot melt lines are disposed on the end faces of the bar-shaped protrusions.

Preferably, the bar-shaped protrusions and the housing are a unitary structure.

Preferably, the housing is further fixed with an electrical connection member for electrically connecting the loudspeaker unit with the cable, an end of the cable located in the interior of the module is welded on the electrical connection member, and the positioning slot is disposed between the electrical connection member and an edge of the housing.

Preferably, the housing comprises an upper housing, a middle housing and a lower housing which are engaged together in sequence, the loudspeaker unit, the middle housing and the lower housing jointly encompass to form a rear acoustic cavity of the module, and both the positioning slot and the electrical connection member are disposed on a surface of the middle housing located in the rear acoustic cavity.

Preferably, the middle housing is provided with two positioning posts, two positioning holes matched with the positioning posts are provided respectively at locations on the electrical connection member corresponding to the positioning posts, and the electrical connection member is fixed on the middle housing through mutual mating of the positioning posts find the positioning holes.

The present disclosure achieves the following advantageous effects by employing the above technical solutions:

The loudspeaker unit of the loudspeaker module according to the present disclosure is electrically connected with the module external circuit through the cable, the positioning slot is disposed at a location of the interior of the housing corresponding to the cable, the cable is restricted in the positioning slot the hot melt line is disposed on each of end faces of sidewalls on both sides of the positioning slot, and the hot melt lines, after being hot molten, encapsulate the cable in the positioning slot. When the module is assembled, the cable is held in the positioning slot, and the positioning slot functions in positioning the cable in the horizontal direction. The molten rubber formed after the hot melt lines disposed on the end faces of the sidewalls of the positioning slot melts flows in the positioning slot and covers the cable and thereby encapsulates the cable in the positioning slot and functions in positioning the cable in the height direction. Such scheme combining the positioning slot with the hot melt line enables the cable to fit close to the surface of the housing to a maximum degree, and is not confronted with unfirm affixation such as turning up, thereby effectively reducing the influence exerted by the cable on the air stream, boosting the acoustic performance of the loudspeaker module, and meanwhile improving the uniformity of the loudspeaker module.

The longitudinal section of each of the hot melt lines is a right-angle triangle, a right-angle side of each of the hot melt lines overlaps the end faces of the sidewalls of the positioning slot, and the other right-angle side of each of the hot melt lines is disposed adjacent to an opening of the positioning slot. Disposing the other right-angle side of the hot melt lines adjacent to the opening of the positioning slot assists the molten rubber of the hot melt lines in automatically flowing towards the positioning slot, and increases the effect of positioning the cable so that the cable is fixed more firmly.

To conclude, the loudspeaker module according to the present disclosure solves the technical problem about difficult positioning of the cable in the loudspeaker module of the prior art. The loudspeaker module according to the present disclosure achieves effective positioning of the cable in a limited space, effectively reduces the influence exerted by the cable on the air stream in the module, and exhibits a high acoustic performance and good uniformity.

BRIEF DESCRIPTION OF DRAWINGS

The present invention will hereinafter be described in conjunction with the following drawing figures, wherein like numerals denote like elements, and.

In the Figures, the reference number 10 denotes upper housing, 20 middle housing, 22 positioning post, 24 bar-shaped protrusion, 26 hot melt line, 28 covering layer, 30 vibrating diaphragm, 32 dome, 34 voice coil, 40 frame, 50 electrical connection member, 52 bonding pad, 60 cable, 70 positioning slot.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

The present disclosure is further illustrated in conjunction with the figures and the embodiments.

The orientation "up" involved in the present description refers to the direction of the vibration system of the loudspeaker unit, and the orientation "down" refers to the direction of the magnetic circuit system of the loudspeaker unit.

Figure 1:
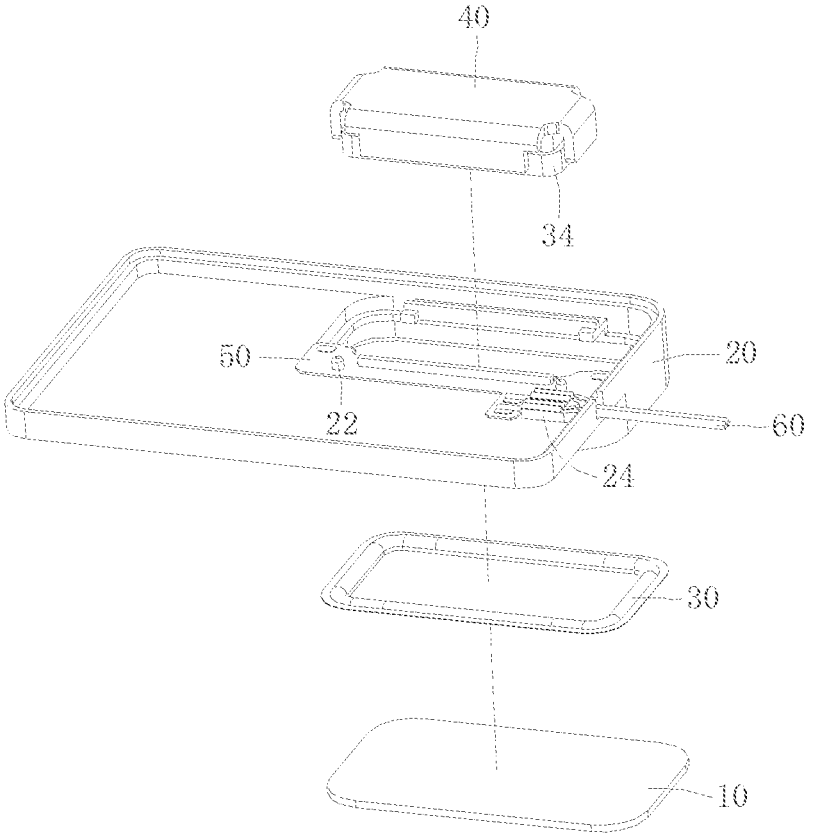
FIG. 1 is a 3-dimensional exploded structural schematic view of a loudspeaker module according to the present disclosure not including a lower housing when hot melting is not performed.
Figure 2:
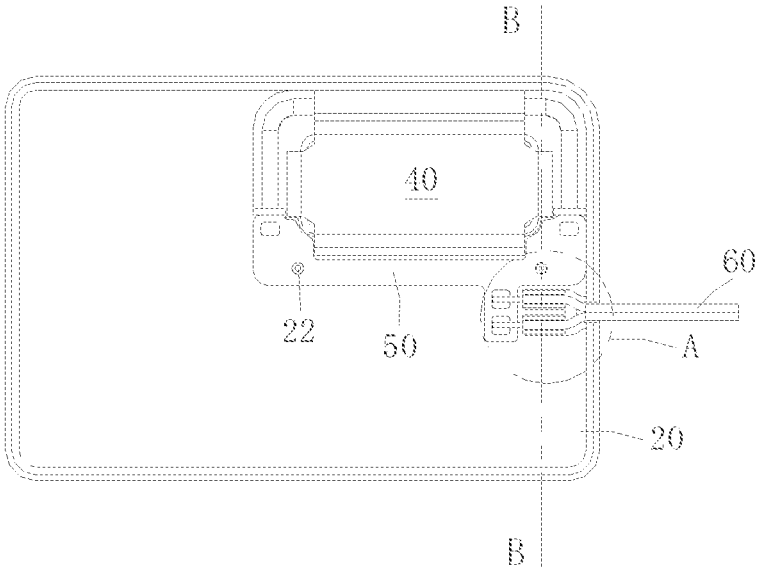
FIG. 2 is a combination view of FIG. 1.
Figure 3:
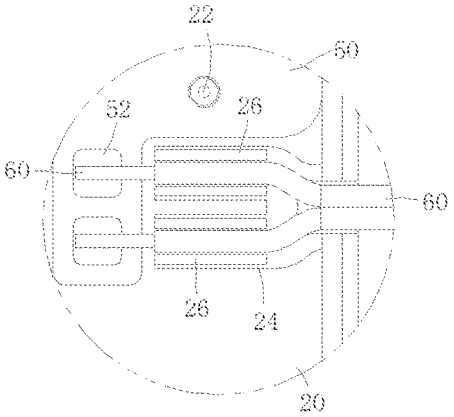
FIG. 3 is an enlarged view of the portion A of FIG. 2.

As jointly shown in FIG. 1, FIG. 2 and FIG. 3, a loudspeaker module comprises a housing consisting of an upper housing 10, a middle housing 20 and a lower housing (not shown) that are engaged together in sequence, and a loudspeaker unit is received in the space encompassed by the upper housing 10, the middle housing 20 and the lower housing. The loudspeaker unit partitions the whole module internal cavity into two acoustic cavities, namely, a front acoustic cavity and a rear acoustic cavity. The loudspeaker unit, the upper housing 10 and the middle housing 20 jointly encompass to form the front acoustic cavity of the module, and the loudspeaker unit, the middle housing 20 and the lower housing jointly encompass to form the rear acoustic cavity of the module. An electrical connection member 50 is fixed at a location on a surface of the middle housing 20 adjacent to the loudspeaker unit in the rear acoustic cavity, a side of the electrical connection member 50 is electrically connected with the loudspeaker unit, the other side of the electrical connection member 50 is provided with two bonding pads 52, a cable 60 is welded to each of the two bonding pads 52, and the ends of the two cables 60 both pass through the rear acoustic cavity and are electrically connected with the module external circuit.

Figure 5:
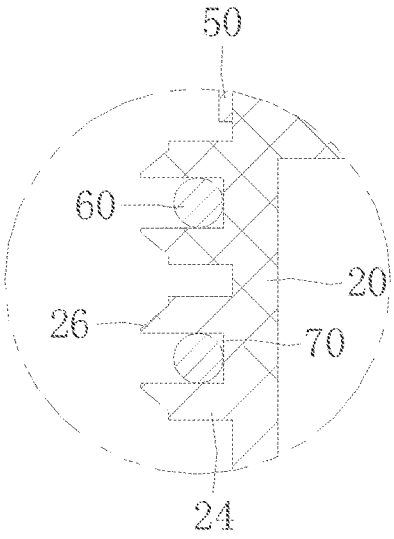
FIG. 5 is an enlarged view of the portion C of FIG. 4.

As jointly shown in FIG. 2, FIG. 3 and FIG. 5, a positioning slot 70 is disposed respectively at locations on the surface of the middle housing 20 in the rear acoustic cavity corresponding to the two cables 60. The electrical connection member 50 is in a shape of a long bar, it extends in the direction perpendicular to an edge of the middle housing 20 through which the cables 60 pass, the side of the electrical connection member 50 not electrically connected with the loudspeaker unit is provided with a protruding welding portion, the two bonding pads 52 are both disposed on the welding portion, the welding portion is parallel to the edge of the middle housing 20 through which the cables 60 pass, and the two positioning slots 70 are disposed parallel between the welding portion and the edge of the middle housing 20. The two cables 60 are respectively restricted in a corresponding positioning slot 70, the depths of the two positioning slots 70 are slightly larger than the diameters of the cables 60, the two positioning slots 70 converge into a slot at the edge of the middle housing 20, and the two cables 60 converge there and pass through the rear acoustic cavity at a cutout of a sidewall of the middle housing 20.

Figure 4:
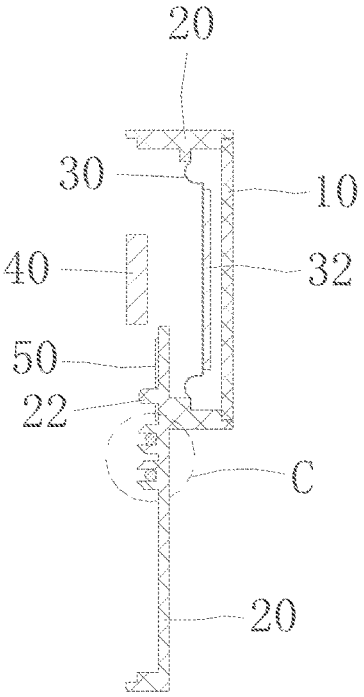
FIG. 4 is a sectional view taken along the line B-B of FIG. 2.
Figure 6:
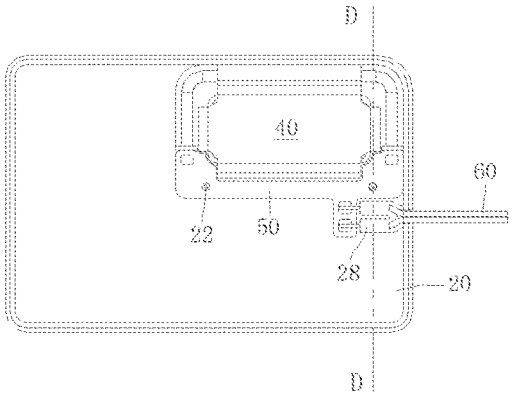
FIG. 6 is a structural schematic view of the loudspeaker module according to the present disclosure with the lower housing not mounted after hot melting is performed.
Figure 7:
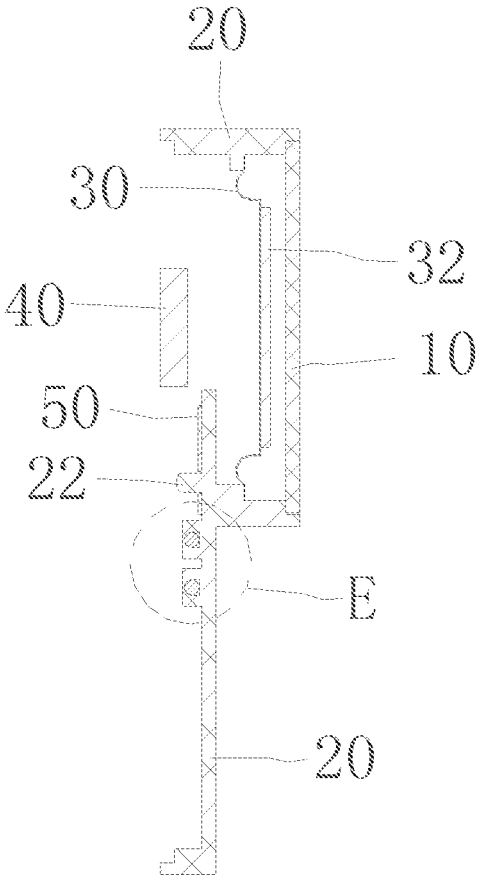
FIG. 7 is a sectional view taken along the line D-D of FIG. 6.
Figure 8:
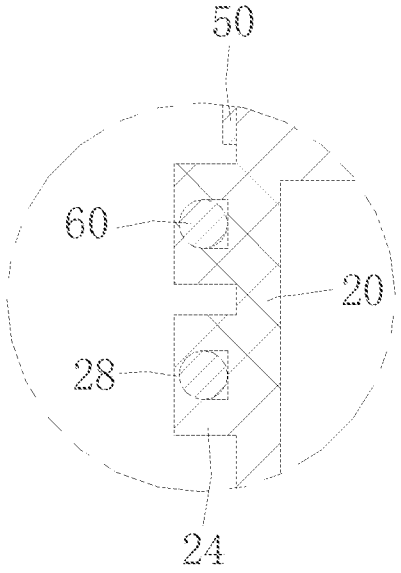
FIG. 8 is an enlarged view of the portion E of FIG. 7.

As jointly shown in FIG. 3, FIG. 4 and FIG. 5, the positioning slot 70 is formed by two bar-shaped protrusions 24 disposed on the surface of the middle housing 20 and formed integrally with the middle housing 20, the two bar-shaped protrusions 24 are disposed parallel to each other, the two bar-shaped protrusions 24 are two sidewalls of the positioning slot 70, the space between the two bar-shaped protrusions 24 is the positioning slot 70, and the heights of the two bar-shaped protrusions 24 are slightly greater than the diameters of the cables 60. A hot melt line 26 is disposed on each of the end faces of the two bar-shaped protrusions 24, the extension direction of the hot melt lines 26 is the same as the extension direction of the bar-shaped protrusions 24, The longitudinal section of each of the hot melt lines 26 (namely, the section perpendicular to its extension direction) is a right-angle triangle, a right-angle side of each of the hot melt lines 26 overlaps the end faces of the bar-shaped protrusions 24, and the other right-angle side of the hot melt lines 26 is adjacent to the opening of the positioning slot 70. In the present embodiment, preferably, the other right-angle side of the hot melt lines 26 is in the same plane as a side surface of the bar-shaped protrusions 24 located in the positioning slot 70. When the hot melt lines 26 are not molten, the molten rubber automatically flows into the positioning slot 70, and a covering layer 28 is formed over the cables 60 (as shown in FIGS. 6, 7 and 8) to encapsulate the cables firmly in the positioning slot 70. Such a scheme of providing the hot melt lines 26 on the sidewalls of the positioning slot 70 results in the well positioning the cables 60, fits the cables 60 close to the surface of the middle housing 20, saves the space of the rear acoustic cavity to a maximum degree, effectively reduces the influence exerted by the cables 60 on the air stream in the rear acoustic cavity, boosts the acoustic performance of the loudspeaker module, and meanwhile improves the uniformity of the loudspeaker module.

As jointly shown in FIG. 1 and FIG. 4, the loudspeaker unit comprises a vibration system and a magnetic circuit system, the vibration system comprises a vibrating diaphragm 30 whose edge is fixed on the middle housing 20, a dome 32 is fixed at a middle portion of the side of the vibrating diaphragm 30 adjacent to the upper housing 10, and the other side of the vibrating diaphragm 30 is fixed with a voice coil 34. The magnetic circuit system comprises a frame 40 fixed on the middle housing 20, a magnet and a washer (not shown in the figures) are fixed to the middle portion of the frame 40 in sequence, and a magnetic gap is formed between the magnet and the washer and the sidewall of the frame 40. An end of the voice coil 34 is located in the magnetic gap, a voice coil lead wire (not shown in the figures) of the voice coil 34 is electrically connected with the electrical connection member 50, and then electrically connected with the module external circuit via the cables 60 to obtain an acoustic wave electrical signal. The voice coil 34 makes a reciprocating up-down movement in the magnetic gap according to the magnitude and the direction of the acoustic wave electrical signal which is through its winding, and the vibrating diaphragm 30 vibrates along with the up-down movement of the voice coil 34, to urge air to generate a sound and thereby complete the electro-acoustic energy conversion.

As jointly shown in FIG. 2 and FIG. 4, the middle housing 20 is provided with two positioning posts 22, a positioning hole is provided respectively at locations on the electrical connection member 50 corresponding to the two positioning posts 22, the positioning holes are matched with the positioning posts 22, and the electrical connection member 50 is fixed on the middle housing 20 through the mutual mating of the positioning posts 22 and the positioning holes.

The technical solution of the present disclosure of fixing the cables through the positioning slots and the hot melt lines is not limited to the loudspeaker module having the above structure, the above loudspeaker module is only intended to illustrate this technical solution, and this technical solution is suitable for all the loudspeaker modules using the cable as the electrical connection member in practical application. Those skilled in the art may apply the technical solution of the present disclosure to modules with other structures according to the describing in the description without paying creative work. Therefore, no matter whether modules with other structures are the same as the module structure in the above embodiments, they fall within the protection scope of the present disclosure so long as they are products using the positioning slots and the hot melt lines to fix the cables.

The present disclosure is not limited to the above embodiments. Diverse variations envisaged by those skilled in the art from the above idea without paying creative work all fall within the protection scope of the present disclosure.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A loudspeaker module, comprising a housing, a loudspeaker unit being received in the housing, the loudspeaker unit being electrically connected with a module external circuit via a cable, an end of the cable located in the interior of the module being electrically connected with the loudspeaker unit, an end of the cable located external to the module being electrically connected with the module external circuit, wherein a positioning slot is disposed at a position on the housing corresponding to the cable in the interior of the module, the cable is restricted in the positioning slot, a hot melt line is disposed on each of end faces of sidewalls on both sides of the positioning slot, and the hot melt lines, after being hot molten, encapsulate the cable in the positioning slot.

2. The loudspeaker module according to claim 1, wherein an extension direction of each of the hot melt lines is the same as an extension direction of the positioning slot.

3. The loudspeaker module according to claim 2, wherein a longitudinal section of each of the hot melt lines is a right-angle triangle, a right-angle side of each of the hot melt lines overlaps the corresponding end face of the sidewall of the positioning slot, and the other right-angle side of each of the hot melt lines is disposed adjacent to an opening of the positioning slot.

4. The loudspeaker module according to claim 3, wherein the other right-angle side of each of the hot melt lines is in the same plane as an inner surface of the sidewall of the positioning slot.

5. The loudspeaker module according to claim 4, wherein the sidewalls of the positioning slot are two bar-shaped protrusions disposed parallel on an inner surface of the housing, a space between the two bar-shaped protrusions is the positioning slot, and the hot melt lines are disposed on the end faces of the bar-shaped protrusions.

6. The loudspeaker module according to claim 5, wherein the bar-shaped protrusions and the housing are a unitary structure.

7. The loudspeaker module according to claim 1, wherein the housing is further fixed with an electrical connection member for electrically connecting the loudspeaker unit with the cable, an end of the cable located in the interior of the module is welded on the electrical connection member, and the positioning slot is disposed between the electrical connection member and an edge of the housing.

8. The loudspeaker module according to claim 7, wherein the housing comprises an upper housing, a middle housing and a lower housing which are engaged together in sequence, the loudspeaker unit, the middle housing and the lower housing jointly encompass to form a rear acoustic cavity of the module, and both the positioning slot and the electrical connection member are disposed on a surface of the middle housing located in the rear acoustic cavity.

9. The loudspeaker module according to claim 8, wherein the middle housing is provided with two positioning posts, two positioning holes matched with the positioning posts are provided respectively at locations on the electrical connection member corresponding to the positioning posts, and the electrical connection member is fixed on the middle housing through mutual mating of the positioning posts and the positioning holes.

* * * * *